US006280375B1

(12) United States Patent
Meisberger et al.

(10) Patent No.: US 6,280,375 B1
(45) Date of Patent: Aug. 28, 2001

(54) FLOW-THROUGH CENTRIFUGE FOR CENTRIFUGING BIOLOGICAL FLUIDS

(75) Inventors: Artur Meisberger, St. Wendel; Wolfram Weber, Spiesen-Elversberg; Carlo Lay, Saarwellingen; Friederich Witthaus, St. Wendel; Stefan Kreber, Saarbrücken; Henning Brass, Homburg, all of (DE)

(73) Assignee: Fresenius AG, Bad Homburg (DE)

( * ) Notice: Subject to any disclaimer, the term of this patent is extended or adjusted under 35 U.S.C. 154(b) by 0 days.

(21) Appl. No.: 09/233,311

(22) Filed: Jan. 19, 1999

(30) Foreign Application Priority Data

Jan. 19, 1998 (DE) ..... 198 01 761

(51) Int. Cl.[7] ..... B04B 1/00; B04B 7/00; B04B 9/00

(52) U.S. Cl. ..... 494/84; 494/45

(58) Field of Search ..... 494/18, 45, 84

(56) References Cited

U.S. PATENT DOCUMENTS 3,304,990 * 2/1967 Ontko et al. .
3,712,535 * 1/1973 Genese et al. .
4,113,173 * 9/1978 Lolachi .
4,129,249 * 12/1978 Todd .
4,226,669 * 10/1980 Vilardi .
4,285,463 * 8/1981 Intengan .
4,341,343 * 7/1982 Beckman .
4,363,525 12/1982 Poubeau .
4,425,112 * 1/1984 Ito ..... 494/18
4,540,397 * 9/1985 Lolachi et al. ..... 494/84
4,776,832 * 10/1988 Martin et al. ..... 494/19
5,683,341 * 11/1997 Giebeler ..... 494/16

FOREIGN PATENT DOCUMENTS

3242541 * 5/1984 (DE) .
32 42 541 5/1984 (DE) .
40 08 945 9/1990 (DE) .
55 086 552 6/1980 (JP) .
96/04996 * 2/1996 (WO) .
96/40322 * 12/1996 (WO) .

* cited by examiner

*Primary Examiner*—W. L. Walker
*Assistant Examiner*—Marianne Ocampo
(74) *Attorney, Agent, or Firm*—Kenyon & Kenyon

(57) ABSTRACT

A centrifuge, especially a flow-through centrifuge free of rotating seals, for centrifuging biological fluids has a stand on which a frame (1) is rotatably mounted. A centrifuge chamber (3) is rotatably mounted on the rotating frame (1) to rotate about the axis of the latter. The centrifuge chamber (3) is driven in the same direction of rotation as the frame (1) but at twice the rotational speed. Coupling elements which are engaged by magnetic forces and are designed in the manner of a clutch disk or a gearwheel are used to transmit the torque to the centrifuge chamber or the rotating frame. Force is transmitted in a non-contact and wear-free manner. No lubrication is necessary, which also reduces the buildup of dust and dirt. In addition, there is little generation of noise.

26 Claims, 7 Drawing Sheets

FLOW-THROUGH CENTRIFUGE FOR CENTRIFUGING BIOLOGICAL FLUIDS

FIELD OF THE INVENTION

The present invention relates to a centrifuge, in particular a flow-through centrifuge for centrifuging biological fluids, such as blood, and capable of being free of rotating seals.

RELATED TECHNOLOGY

With such a centrifuge, the biological fluid is centrifuged in a flow-through process, with the fluid flowing through a line into and out of the rotating centrifuge chamber. The line routing proves to be problematical because of the relative movement between the centrifuge chamber and the stationary connection point of the line. Traditional flow-through centrifuges use rotating joints to prevent the line from twisting. German Patent Application No. 3,242,541 A discloses a blood centrifuge free of rotating seals, with the line being guided in a loop around the centrifuge chamber at half the rotational speed of the centrifuge chamber. To do so, the line is connected to a rotating frame which rotates at half speed in comparison with the centrifuge chamber. To drive the centrifuge chamber and the rotating frame, it is proposed that the rotating frame be connected to a hollow shaft, and that the centrifuge chamber be driven with a drive shaft extending through the hollow shaft. A belt drive is used to transmit the torque from the drive shaft to the centrifuge chamber. A blood centrifuge with a belt drive is also disclosed in U.S. Pat. No. 4,425,112.

International Patent Application No. WO 96/40322 discloses a blood centrifuge characterized by a very compact design. The centrifuge chamber and the line pusher are driven at half the rotational speed in the same direction of rotation as the chamber by a toothed gear. One disadvantage is the relatively loud running noises of the gearwheels, which noises are perceived as unpleasant by both the donor and the personnel. Furthermore, using gearwheels requires a high-precision manufacturing process for the centrifuge, which is therefore very expensive. Furthermore, the gearwheels must be lubricated, which not only increases the maintenance cost of the centrifuge but also leads to a buildup of dust and dirt. Therefore, the gear should be completely closed. However, arranging the gear in a closed casing in turn leads to problems in dissipating the resulting heat loss. In addition, the gearwheels are subjected to constant wear.

International Patent Application No. WO 96/04996 discloses a centrifuge in which the centrifuge chamber is designed as the rotor of an electric motor. However, this known centrifuge is not a flow-through centrifuge where there is the problem of twisting of the line.

SUMMARY OF THE INVENTION

An object of the present invention is to create a centrifuge capable of being free of rotating seals that will have low running noise and a drive that is largely maintenance-free while permitting operation at high rpms and relatively low driving power.

The present invention provides a centrifuge having:

a stand (21) on which a frame (1) is rotatably mounted, a separation unit (3) rotatably mounted on the rotating frame (1), a first drive train for transmitting the torque to the separation unit (3), a line (7) for supplying and/or removing at least one fluid, leading from a stationary connection point (6) around the separation unit (3) and connected to the separation unit (3) on a side of the separation unit (3) facing away from the stationary connection point, and a second drive train for transmitting a second torque to the rotating frame (1), with the separation unit (3) and the rotating frame (1) being driven so that the separation unit (3) rotates in the same direction as the rotating frame (1) but at twice the speed.

The centrifuge of the present invention is characterized in that the first and/or second drive train has coupling elements (17 to 20) arranged with a distance between them and designed so that the torques can be transmitted using magnetic forces.

The present invention also provides a centrifuge characterized in that the first and/or second drive train has at least one stator (143) with a first and/or second coil arrangement (142) and a mechanism (145/136) for magnetic coupling, designed so that the torques can be transmitted by magnetic forces.

The centrifuge according to the present invention has two drive trains, with the first drive train serving to transmit the torque to the centrifuge chamber and the second drive train serving to transmit the torque to the rotating frame. The centrifuge chamber and the rotating frame can be driven by a common motor or by separate motors.

The first and/or second drive train has coupling elements arranged with a spacing between them for transmitting the torque; said coupling elements are designed so that the torque can be transmitted by magnetic forces. Force is transmitted in a non-contact and wear-free manner. Lubrication is not necessary, which therefore also reduces the accumulation of dust and dirt. In addition, little noise is generated. It is also advantageous that the line for supplying and/or removing the fluid can be passed through the gap between coupling elements, thereby simplifying the spatial arrangement of drive elements. The coupling elements may be in one piece with the centrifuge chamber or the rotating frame. However, they may also be spatially separated from the centrifuge chamber and the rotating frame, with the torque being transmitted from the respective coupling element to the centrifuge chamber or the rotating frame by way of additional coupling elements which are magnetically engaged, or additional gear elements of a wide variety of designs. The magnets may be attached to the top or bottom side of the clutch disks. However, they may also be integrated into the clutch disks or they may be of one piece with the centrifuge chamber. For example, the gaps between the magnets may be filled with a casting compound to produce smooth surfaces.

It has been found in experiments that a relatively great torque can be transmitted in particular when the coupling elements have magnets arranged on a circumference such that the magnetic poles of adjacent magnets of a coupling element are arranged in opposition to one another. The magnets are preferably permanent magnets. In principle, however, electromagnets can also be used for transmission of torque.

The coupling elements may be designed in the manner of a clutch disk. In a preferred embodiment of the centrifuge, two coupling elements designed in the manner of a clutch disk mounted to rotate about a common axis may be provided in the first and/or second drive train(s), with the magnets being arranged in opposition to one another along the circumference on the top or bottom side of the coupling elements. Such an arrangement serves to transmit torques with the shafts of the drive train aligned.

It has surprisingly been found that a relatively high torque can be transmitted even when the clutch disks are mounted rotatably about two parallel axes, with the magnets being arranged in opposition to one another only along part of the circumference on the top or bottom side of the coupling elements. Such an arrangement serves to transmit torques when the shafts are not aligned.

However, the coupling elements may also be designed in the manner of a gearwheel. In a preferred embodiment, two coupling elements mounted rotatably about perpendicular axes are provided in the first and/or second drive train of the centrifuge. The coupling elements may be designed as bodies in the form of truncated cones with the magnets arranged on the conical faces, or the coupling elements may be designed as disk-shaped bodies, with the magnets arranged on the top or bottom side thereof.

In an especially preferred embodiment, the magnets have a rectangular cross section with one narrow side and one long side. The magnets preferably are arranged on the circular disk-shaped coupling elements in such a way that their longitudinal axes run radially. This arrangement allows an especially large torque to be transmitted at a low angle offset. The lateral spacing between the magnets of a coupling element is optimal when it corresponds essentially to the spacing between the magnets of one coupling element and the opposing magnet of the other coupling element which is magnetically engaged with the first coupling element.

In an alternative embodiment of the blood centrifuge, which is based on the same principle, however, namely the principle of magnetic coupling, the centrifuge includes a stator with a coil arrangement for generating a first and a second magnetic field and a mechanism for magnetic coupling of the rotating frame such that the centrifuge chamber can be driven by the first magnetic field of the stator and the mechanism for magnetic coupling of the centrifuge chamber such that the centrifuge chamber can be driven by the second magnetic field of the stator. The magnetic fields of the stator are designed so that the centrifuge chamber is driven in the same direction of rotation as the rotating frame but at twice the rpm.

An important advantage of the alternative embodiment is the especially compact design. It is also characterized by low running noise and extensive freedom from maintenance and can be operated at high speeds and at a relatively low drive power.

The rotating frame of the centrifuge preferably has a top and a bottom carrying plate, with the centrifuge chamber being rotatably mounted on the top carrying plate and the stator being arranged between the centrifuge chamber and the bottom carrying plate. The line connected to the centrifuge chamber can be guided to the stationary connection through the air gap between the centrifuge chamber and the stator.

The mechanism for magnetic coupling of the rotating frame and the centrifuge chamber are preferably permanent magnets arranged on the rotating frame or the centrifuge chamber, distributed around the periphery on the bottom side of the centrifuge chamber or the bottom carrying plate of the rotating frame, with the magnetic poles of adjacent magnets being aligned in opposition to one another. The centrifuge chamber and the rotating frame are driven by magnetic rotating fields generated by the coil elements.

BRIEF DESCRIPTION OF THE DRAWINGS

Several embodiments of the present invention are described in greater detail below with reference to the drawings, in which.

DETAILED DESCRIPTION

Figure 1:
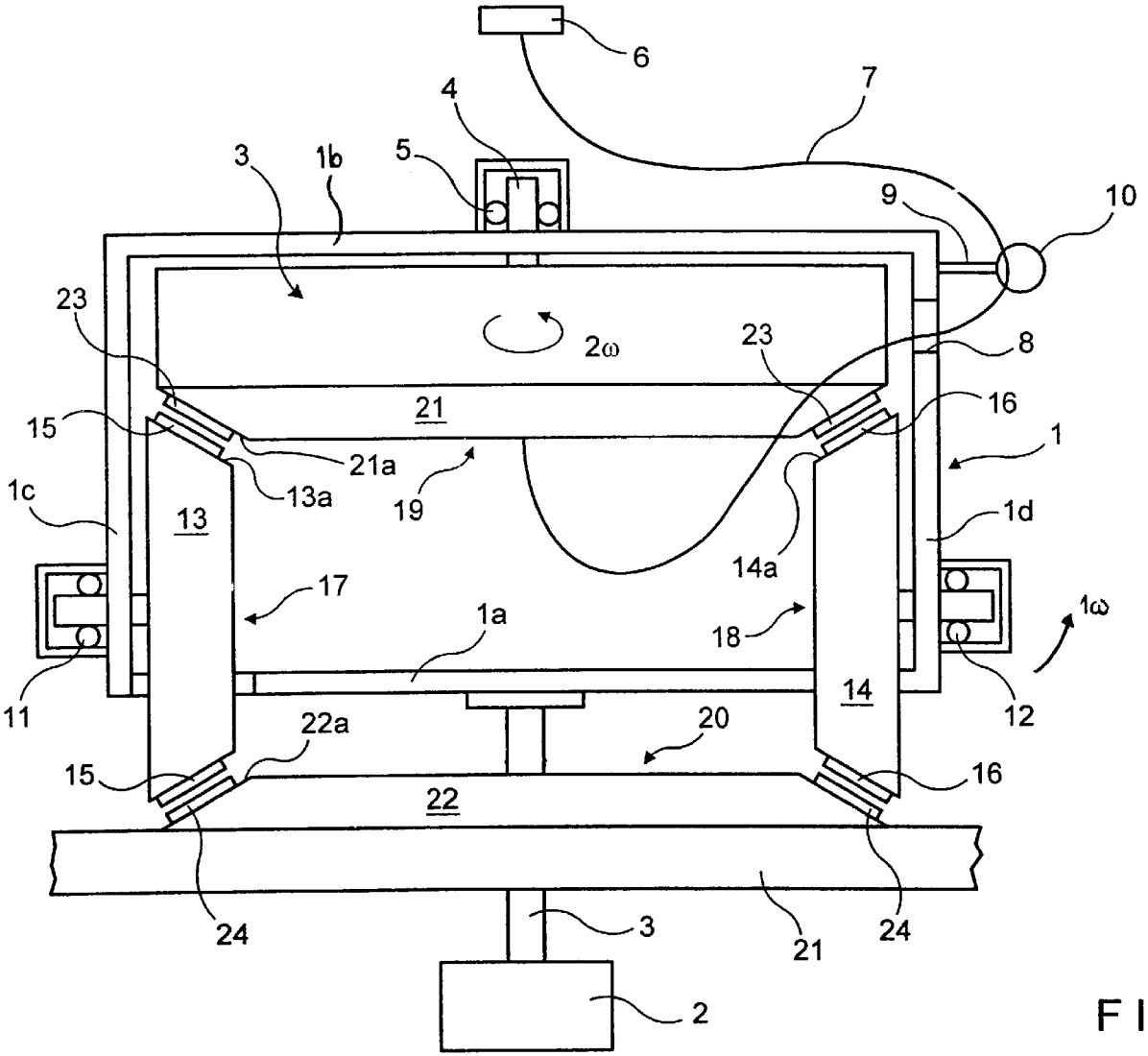
FIG. 1 shows a schematic diagram of a first embodiment of a centrifuge of the present invention, with the coupling elements designed in the manner of a gearwheel.

FIG. 1 shows a schematic diagram of a first embodiment of a centrifuge free of rotating seals for centrifuging biological fluids, especially blood. The centrifuge has a rotating frame 1 with top and bottom carrying plates 1*b*, 1*a* and two side parts 1*c*, 1*d*. Rotating frame 1 is driven by an electric motor 2 whose drive shaft 3 is connected to bottom carrying plate 1*a* of the rotating frame. A centrifuge chamber 3 arranged in the rotating frame can rotate about the vertical axis of rotation of frame 1. On its top side, centrifuge chamber 3 has a shaft 4 mounted in a bearing 5 on the top carrying plate 1*b* of rotating frame 1. However, it may also be arranged above the top carrying plate.

A flexible line 7 which may combine one or more tubes for supplying blood or blood constituents to centrifuge chamber 3 and removing them from the centrifuge chamber leads from a stationary connection 6 around the centrifuge chamber and is connected to the bottom side of the chamber. Line 7 extends through a central recess 8 of rotating frame 1. A line connection 9 ending in an eye 10 where line 7 is secured is mounted on a side part 1*d* of rotating frame 1. However, the line may also be loosely guided without being connected to the rotating frame.

Two carrier disks 13, 14 in the form of a shallow truncated cone are mounted in bearings 11, 12 on side parts 1*c*, 1*d* of rotating frame 1 to rotate about a common horizontal axis; permanent magnets 15, 16 are mounted at a uniform spacing on their conical faces 13*a*, 14*a*. Carrier disks 13, 14 themselves are preferably made of a ferromagnetic material. Magnets 15, 16 are arranged on the peripheral faces 13*a*, 14*a* of carrier disks 13, 14 so that the magnetic poles of adjacent magnets of one carrier disk are aligned in opposition to one another. Carrier disks 13, 14 with magnets 15, 16 form intermediate coupling elements 17, 18 designed like a gearwheel in magnetic engagement with other coupling elements, forming a gear, and disposed in an intermediate position between third coupling element 19 and fourth coupling element 20.

Intermediate coupling elements 17, 18 mounted rotatably on side parts 1*c*, 1*d* of rotating frame 1 are magnetically engaged with a third coupling element 19 mounted on the bottom side of centrifuge chamber 3, and with a fourth coupling element 20 which is connected to a stationary stand 21. Although carrier disks 13, 14 of the vertical, or intermediate coupling elements 17, 18 each have an even number of magnets, the same number of magnets 23 and 24, also an even number, is distributed at equal intervals on conical faces 21*a* and 22*a* of ferromagnetic carrier disks 21 and 22 of the horizontal coupling elements 19 and 20.

The drive of centrifuge chamber 3 and rotating frame 1 operates as follows. Electric motor 2 drives rotating frame 1 at speed n. The vertical coupling elements 17, 18 which are magnetically engaged with rotationally fixed horizontal coupling element 20 are driven in the opposite direction of rotation by the rotation of rotating frame 1. The vertical coupling elements 17, 18 in turn drive horizontal coupling element 19 which is connected to centrifuge chamber 3 in the same direction of rotation, but at twice the speed. Since rotating frame 1 moves line 7 around the chamber at half the speed of centrifuge chamber 3, twisting of the line is prevented.

Figure 2:
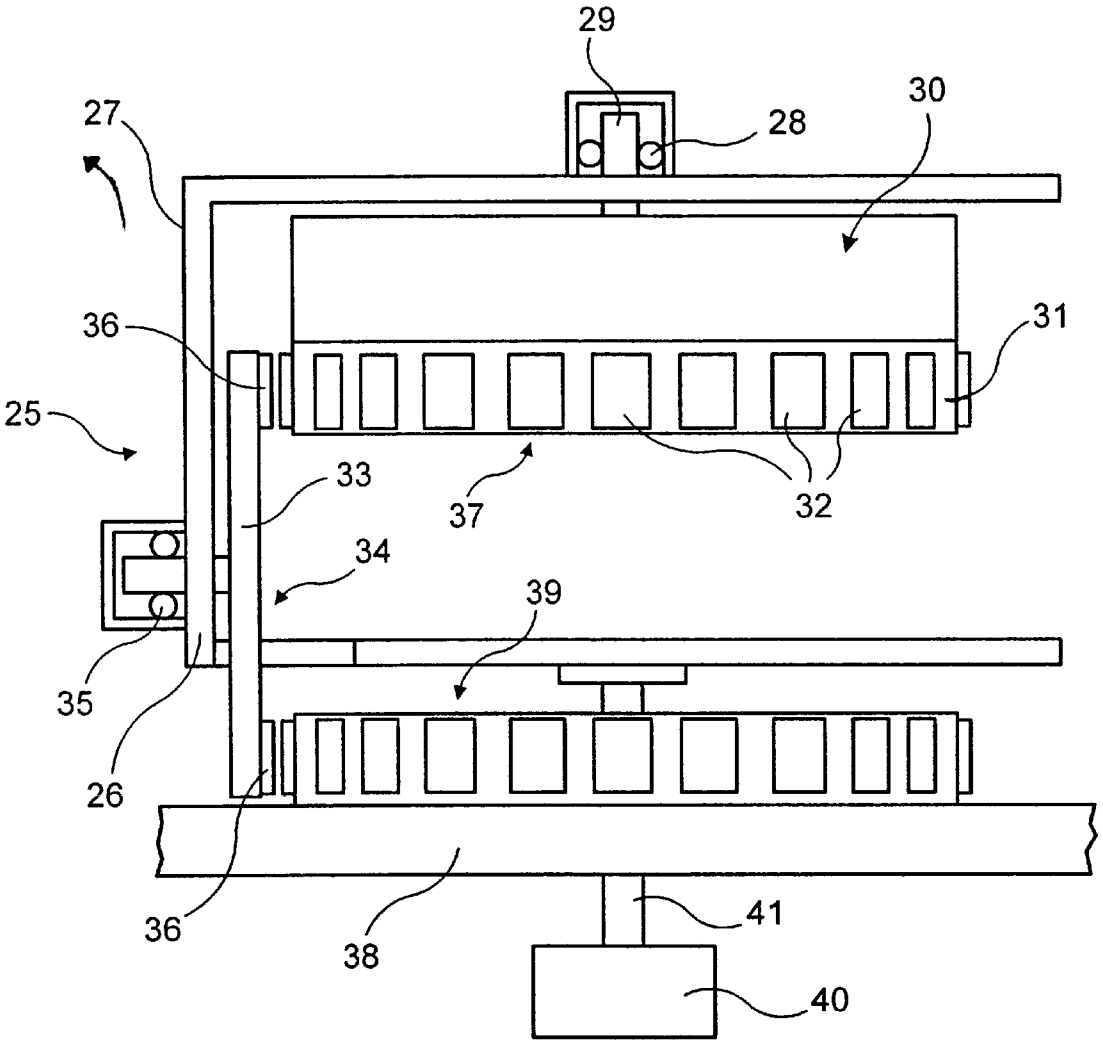
FIG. 2 shows a schematic diagram of a second embodiment of the centrifuge, with the coupling elements designed in the manner of a gearwheel.

FIG. 2 shows a schematic diagram of a second embodiment of the centrifuge. This embodiment differs from the embodiment described with reference to FIG. 1 in that the carrier disks of the coupling elements are cylindrical and only one vertical coupling element is mounted on the side part of the rotating frame, with the rotating frame being open on the side opposite the vertical coupling element. The rotating frame which is open at the side facilitates monitoring of the phase limit in the centrifuge chamber.

In this embodiment, rotating frame 25 comprises a bottom frame half 26 and a top frame half 27, with the top frame half 27 being mounted on the bottom frame half 26 to pivot about an axis, so that the rotating frame can be opened up.

Shaft 29 of centrifuge chamber 30 is mounted rotatably in bearing 28 of top frame half 27 and is connected to horizontal carrier disk 31 on whose peripheral face magnets 32 are distributed at uniform intervals around the circumference. Carrier disk 33 of the vertical coupling element 34 mounted rotatably in bearing 35 on bottom frame half 26 carries magnets 36 on its top side at uniform intervals along the circumference. Vertical coupling element 34 is in turn magnetically engaged with coupling element 37 mounted on centrifuge chamber 30 and with coupling element 39, which is mounted on stationary stand 38 and is designed like coupling element 37 of centrifuge chamber 30.

Centrifuge chamber 30 and rotating frame 25 are driven with the same electric motor 40 whose drive shaft 41 is mounted on the bottom frame half 26 of rotating frame 25. If electric motor 40 drives rotating frame 25 at speed n, centrifuge chamber 30 will rotate at double speed 2n in the same direction of rotation. A line is provided for supplying fluids to and removing them from the centrifuge chamber.

Figure 3:
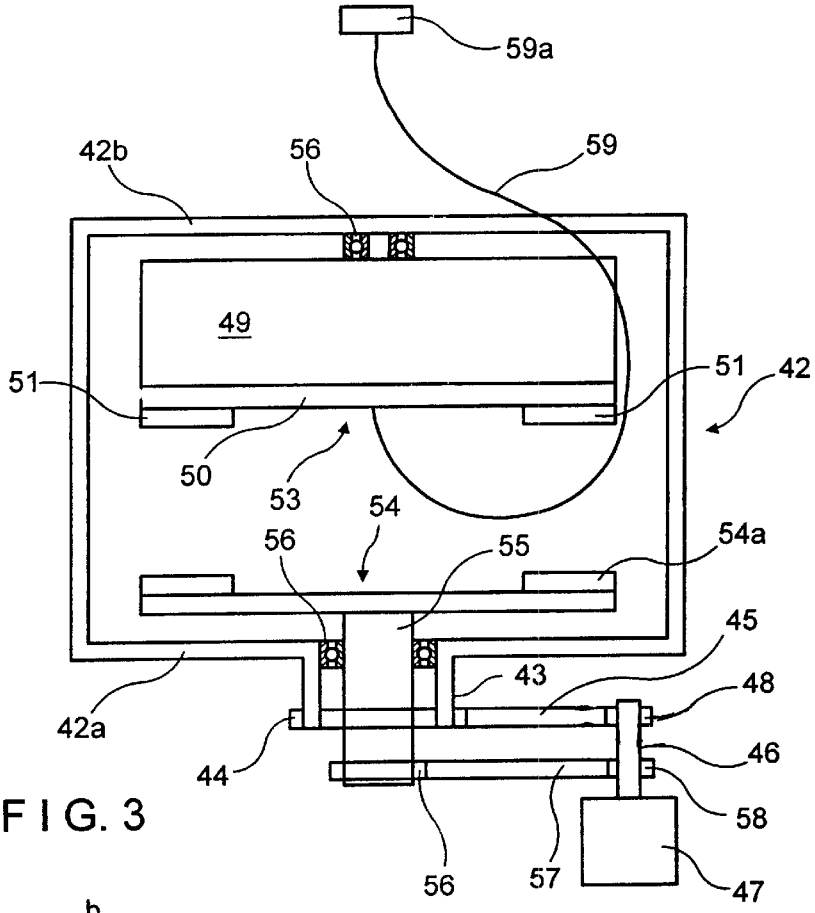
FIG. 3 shows a schematic diagram of a third embodiment of the centrifuge, with the coupling elements designed in the manner of a clutch disk.

FIG. 3 shows a schematic diagram of a centrifuge drive, where the coupling elements are designed as clutch disks. Rotating frame 42 is mounted to rotate about a vertical axis on a stand. A hollow shaft 43 mounted on the bottom carrying plate 42*a* of rotating frame 42 interacts with a pulley 44 with a belt 45 leading to a pulley 48 mounted on drive shaft 46 of an electric motor 47.

Centrifuge chamber 49 is mounted rotatably on the top carrying plate 42*b* of rotating frame 42 with a bearing 50 as in the embodiments described with reference to FIGS. 1 and 2. A circular disk-shaped carrier plate 50 mounted on the bottom side of centrifuge chamber 49 has magnets 51 distributed around its circumference at equal intervals, so that the magnetic poles of adjacent magnets are aligned in opposition to one another. The first clutch disk 53 is magnetically engaged using magnets 54*a* with a second clutch disk 54 of the same design. The latter is mounted on a drive shaft 55 which extends through hollow shaft 43 of rotating frame 42 and is mounted in a bearing 56, which is inserted into hollow shaft 43, and rotates about the axis of rotating frame 42. Drive shaft 55 carries a pulley 56, with a belt 57 leading to a pulley 58 mounted on drive shaft 46 of electric motor 47. Pulley 44 of hollow shaft 43 has a diameter twice as large as that of pulley 56 of drive shaft 55, while pulleys 48, 58 mounted on drive shaft 46 of electric motor 47 have the same diameter, so that rotating frame 42 is driven the same direction of rotation as drive shaft 55 of clutch disk 54, but at half its rotational speed. Clutch disk 54, mounted on drive shaft 55 and magnetically engaged with clutch disk 53 mounted on centrifuge chamber 49, then also drives the centrifuge chamber in the same direction of rotation as the rotating frame but at twice the rotational speed. Line 59 for supplying blood and/or blood constituents to the centrifuge chamber and removing them from the centrifuge chamber is guided to the stationary connection 59*a* through the air gap between clutch disks 53, 54.

Figure 4A:
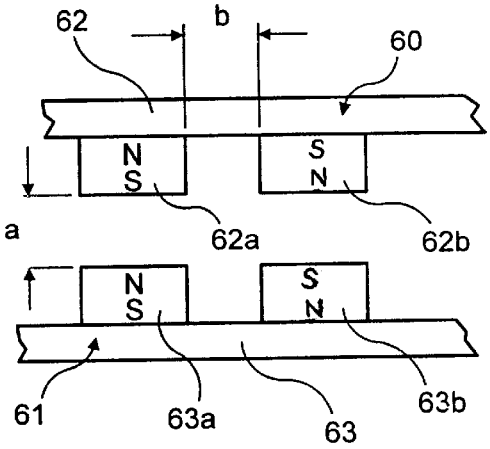
FIG. 4*a* shows a cross section through two clutch disks which are magnetically engaged.
Figure 4B:
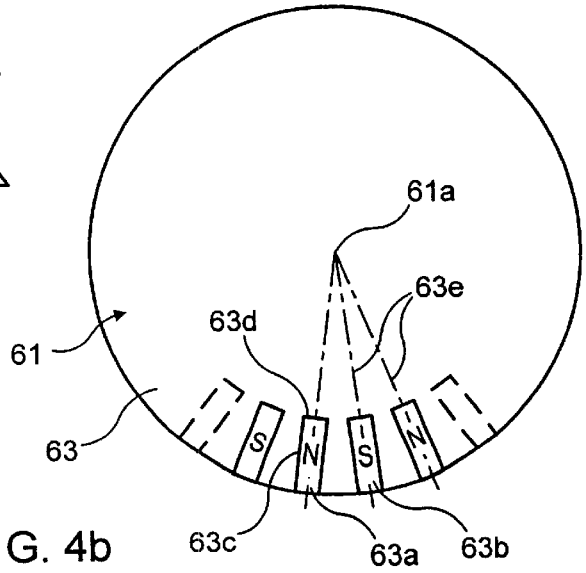
FIG. 4*b* shows a top view of one of the clutch disks.

FIG. 4*a* shows a cross section through two clutch disks 60, 61 which are magnetically engaged. FIG. 4*b* shows a top view of one of the clutch disks 61. Magnets 62*a*, 62*b* are distributed with a uniform spacing around the circumference of the bottom side of carrier plate 62 of the top clutch disk 60, with the magnetic poles of adjacent magnets being aligned in opposition to one another. Carrier disk 63 of the bottom coupling element 61 carries magnets 63*a*, 63*b* on its top side. The magnetic poles are labeled as north N and south S in FIG. 1. When clutch disks 60, 61 are magnetically engaged, the magnets of the two clutch disks are aligned so that magnets of opposite polarities are opposite one another. An especially great torque can be transmitted with a small angle offset when the magnets have a rectangular cross section with long side 63*a* and narrow side 63*d*. The magnets are arranged along the circumference of the carrier disks in such a way that their longitudinal axes 63*e* intersect at midpoint 61*a* of carrier disks 63. Transmission of torque is optimal when the distance a between magnets on opposing clutch disks 60, 61 is essentially equal to distance b between the adjacent magnets on a clutch disk.

Figure 5A:
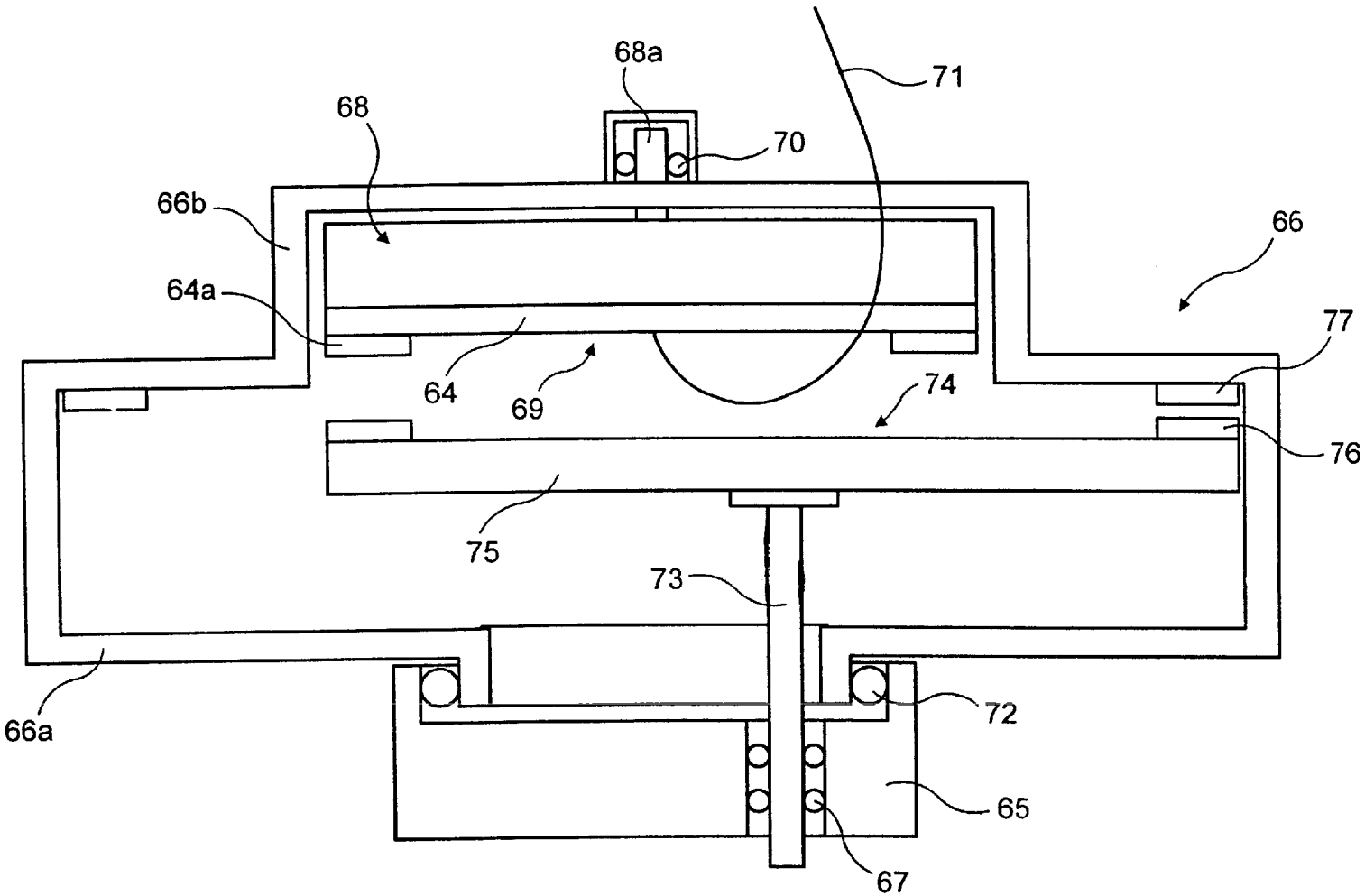
FIG. 5*a* shows a schematic diagram of a fourth embodiment of a centrifuge, with the coupling elements designed in the manner of a clutch disk.
Figure 5B:
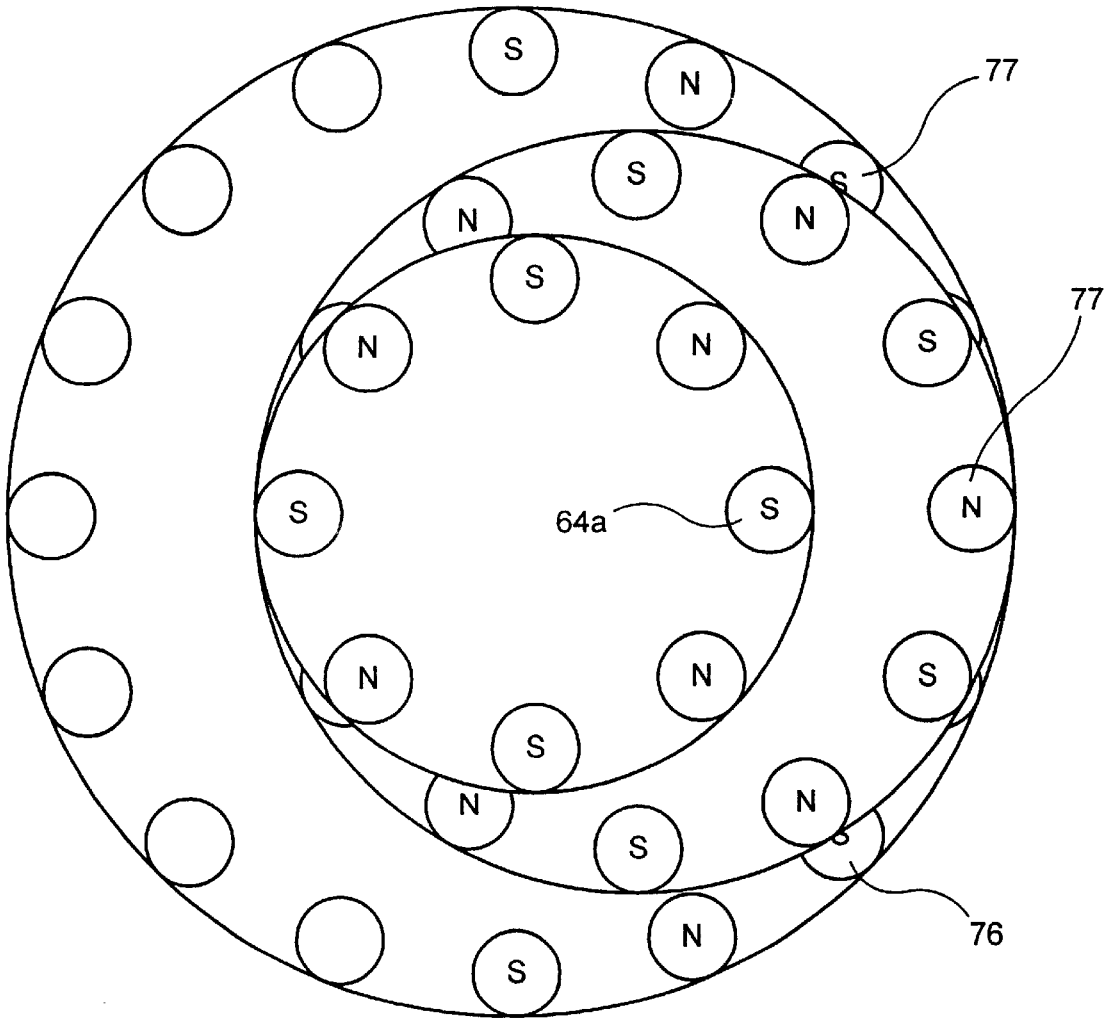
FIG. 5*b* shows a block diagram to illustrate the arrangement of the magnets on the clutch disks of the centrifuge from FIG. 5*a;*

FIGS. 5*a* and 5*b* show a schematic diagram of another embodiment of the blood centrifuge. The blood centrifuge has a stationary stand 65 and a frame 66 comprising a cylindrical bottom frame half 66*a* and a cylindrical top frame half 66*b* having a smaller diameter than the bottom frame half. Bottom frame half 66*a* is mounted with a ball bearing 72 on stationary stand 65 to rotate about a vertical axis. Top frame half 66*b* accommodates centrifuge chamber 68 whose shaft 68*a* is mounted with a ball bearing 70 on the top plate of rotating frame 66 to rotate about the axis of the frame. A coupling element 69 mounted on the bottom side of centrifuge chamber 68 is designed in the manner of a clutch disk. Clutch disk 69 has a cylindrical ferromagnetic carrier plate 64 on whose bottom side are distributed at a uniform spacing an even number of magnets 64*a*, e.g., circular magnets, arranged around the circumference with alternating polarities N, S (FIG. 5*b*) line 71 for supplying and removing blood and/or blood constituents passes through a side opening in the frame to the stationary connection. A drive shaft 73 mounted in a bearing 67 on stationary stand 65 is driven by an electric motor of a drive. Drive shaft 73, arranged with an offset to the side of the axis of rotation of frame 66, is connected to a second coupling element 74 which is designed in the manner of a clutch disk and is arranged in bottom frame half 66*a*. The second clutch disk 74 has a ferromagnetic carrier disk 75 with a larger diameter than carrier disk 64 of the first clutch disk 69. On the top side there are magnets 76 in an even number which is 50% larger than the number of magnets 64. The second clutch disk 74 is magnetically engaged with the first clutch disk 69 over part of its circumference. On the other hand, the second clutch disk 74 is magnetically engaged over part of its circumference with rotating frame 66 around whose circumference are mounted magnets 77 (twice as many as magnets 64*a*) in a uniform spacing so that magnetic poles N, S of adjacent magnets are opposite one another.

The drive of the centrifuge operates as follows. The second clutch disk 74, which is driven at speed 1.5n, in turn drives the first clutch disk 69, which is connected to centrifuge chamber 68, at speed 2n, and also drives rotating frame 66 at speed n in the same direction of rotation as centrifuge chamber 68.

Figure 6A:
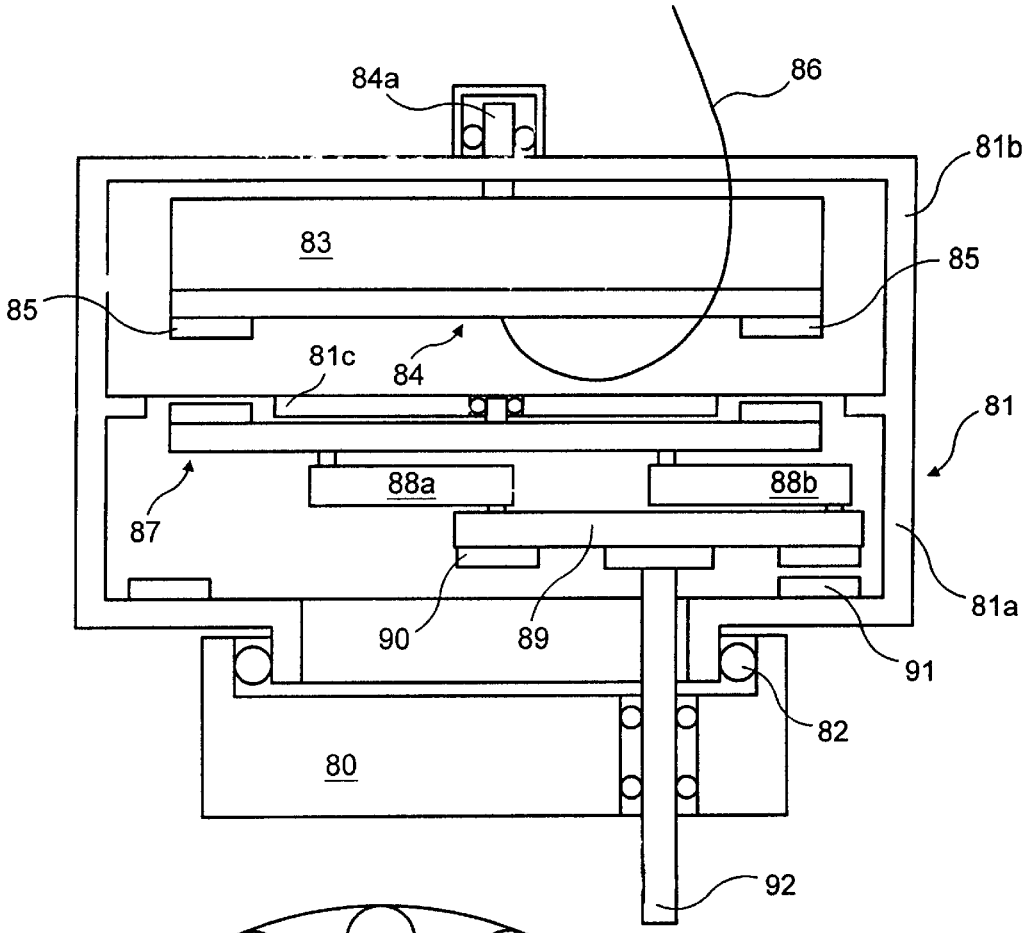
FIG. 6*a* shows a schematic diagram of a fifth embodiment of the centrifuge, with the coupling elements designed in the manner of a clutch disk.
Figure 6B:
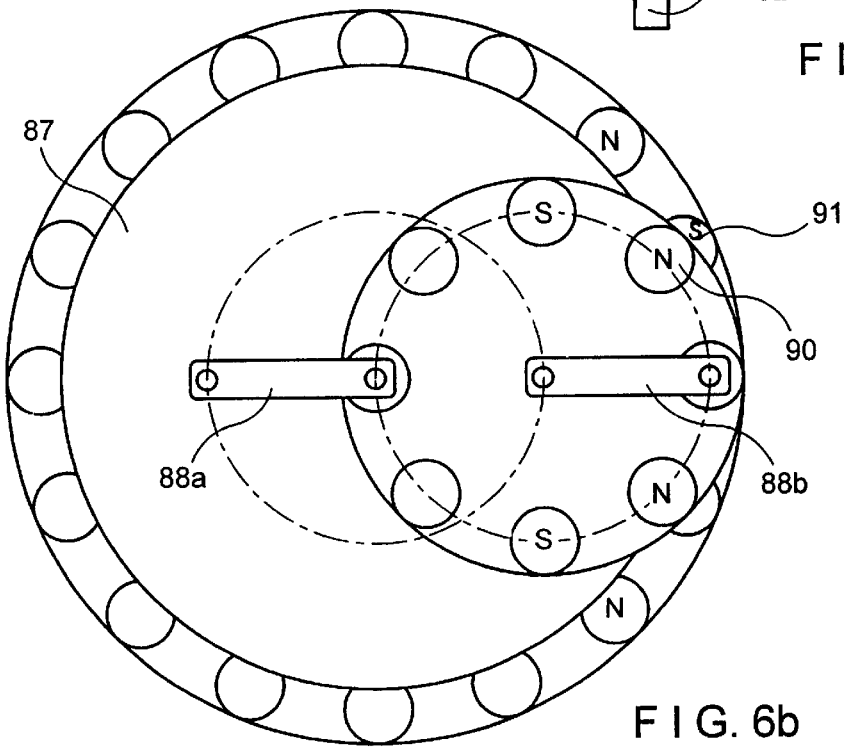
FIG. 6*b* shows a block diagram to illustrate the arrangement of the magnets on the clutch disks of the centrifuge from FIG. 5*a;*

FIGS. 6*a* and 6*b* show another embodiment of the blood centrifuge. The blood centrifuge has a stationary stand 80 and a frame 81. The bottom frame half 81*a* is mounted with a ball bearing 82 on stationary stand 80 to rotate about a vertical axis. The top frame half 81*b*, which is mounted to pivot on the bottom frame half 81*a* or is designed in one piece with the bottom frame half, accommodates centrifuge chamber 83 whose shaft 84*a* is mounted on the top plate of frame 81 to rotate about its axis of rotation. A first coupling element 84 mounted on the bottom side of the centrifuge chamber is designed as a clutch disk with an even number of magnets 85. Line 86 for supplying and removing blood and blood constituents leads to the stationary connection through a side opening in the rotating frame. A second clutch disk 87 of the same diameter as the first clutch disk 84 is mounted on a partition 81*c* of frame 81 at a distance from the first clutch disk 84 so that it can rotate about the axis of rotation of the frame. The second clutch disk 87 is connected to a third coupling element 89, likewise designed as a clutch disk, by two coupling rods 88*a*, 88*b*. Coupling rods 88*a*, 88*b* have an articulated connection to the second clutch disk 87 at two opposite points of a circle, while on the other hand having an articulated connection to the third clutch disk 89 at two opposite points of a circle with the same diameter (FIG. 6*b*). On its bottom side, the third clutch disk 89 has an even number of magnets 90 and is magnetically engaged over part of its circumference with rotating frame 81 on whose bottom plate are provided magnets 91 distributed at a uniform spacing over the circumference but the number of these magnets is twice as high as that of magnets 90. The third clutch disk 89 is connected to a drive shaft 92 which is driven by an electric motor of a drive.

The drive of the blood centrifuge operates as follows. Drive shaft 92, which is connected to the third clutch disk 89, is driven at speed 2n. The third clutch disk 89 in turn drives frame 81 at speed n and also drives the second clutch disk 87 at speed 2n by way of coupling rods 88*a*, 88*b*, and the second clutch disk in turn drives the first clutch disk 84, which is connected to centrifuge chamber 83, in the same direction of rotation as frame 81 but at twice the speed 2n.

Figure 7:
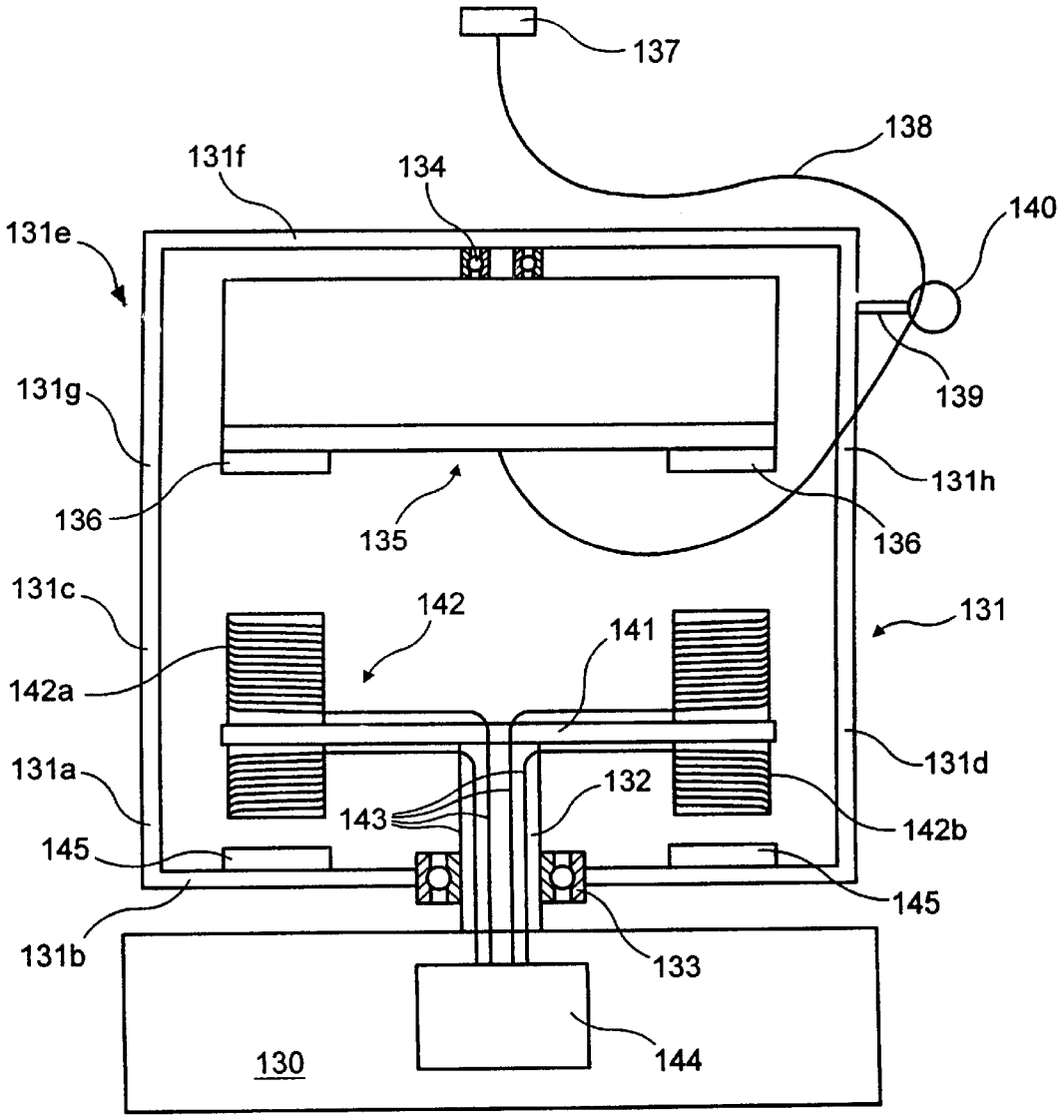
FIG. 7 shows an alternative embodiment of the blood centrifuge, where the centrifuge chamber and the rotating frame are driven by magnetic rotating fields.

FIG. 7 shows a schematic diagram of an alternative embodiment of the blood centrifuge. The blood centrifuge has a stand 130 on which a rotating frame 131 is rotatably mounted. Rotating frame 131 has a bottom frame half 131*a* with a bottom carrying plate 131*b* and two side walls 131*c*, 131*d* and a top frame half 131*e* with a top carrying plate 131*f* and two side walls 131*g*, 131*h*. The rotating frame is open on two opposite sides. The bottom carrying plate 131*b* of rotating frame 131 is rotatably mounted with a roller bearing 133 on a vertical axis 132 extending from stand 130 into frame 131. A centrifuge chamber 135 is mounted on top carrying plate 131*f* of rotating frame 131 with a roller bearing 134 so that it rotates about the axis of the rotating frame. Permanent magnets 136 are attached to the bottom side of centrifuge chamber 135, distributed at a uniform spacing around the circumference, with the magnetic poles of adjacent magnets being aligned opposite one another. To this extent, the design of the centrifuge chamber corresponds to that of the centrifuge chambers described above.

A flexible line 138, which may combine one or more hoses for supplying blood and/or blood constituents to centrifuge chamber 135 and removing them from the centrifuge chamber, leads from a stationary connection 137 around the centrifuge chamber and is connected to the bottom side of the chamber. Line 138 extends through rotating frame 131, which is open at the side. A line connection 139 mounted on a side part 131*h* of rotating frame 131 ends in a loop 140 in which the line is secured. However, line 138 may also be carried loosely without being connected to rotating frame 131.

A plate 141 which carries a coil arrangement 142 is mounted on vertical shaft 132 of stand 130. A first coil 142*a* is mounted on the top side of plate 141, while a second coil 142*b* is mounted on the bottom side of the plate. The two coils 142*a*, 142*b* are connected by electric connecting lines 143 to a control unit 144 in stand 130 of the blood centrifuge.

Additional permanent magnets 145 are distributed at an even spacing on a circumference on the bottom carrying plate 131*b* of rotating frame 131 at a distance from the second coil 142*b*, with the magnetic poles of adjacent magnets being aligned in opposition to one another.

The blood centrifuge operates as follows. The first coil 142*a* generates a first magnetic rotational field, so that centrifuge chamber 135 is driven, while the second coil 142*b* generates a second magnetic rotational field which drives rotating frame 131. The first and second coils 142*a*, 142*b* are driven by control unit 144 so that centrifuge chamber 135 is driven in the same direction of rotation as rotating frame 131 but at twice the speed (rpms) 2n. Twisting of line 138 coming out of the side of the rotating frame is prevented because the line rotates about the centrifuge chamber at half the speed of the latter.

What is claimed is:

1. A centrifuge comprising:

a stand;

a frame rotatably mounted on the stand;

a separation unit rotatably mounted on the frame, rotating in a rotation plane;

a first drive train for transmitting a first torque to the separation unit;

a line for supplying and/or removing at least one fluid, the line leading from a stationary connection point and connected to the separation unit on a side of the separation unit facing away from the stationary connection point; and a second drive train for transmitting a second torque to the frame, the separation unit and the rotating frame being driven so that the separation unit rotates in a same direction as the frame but at double speed;

at least one of the first and second drive trains having coupling elements arranged at a distance and an intermediate coupling element arranged at a distance from the coupling elements, rotating in a plane other than the rotation plane, so that at least one of the first and the second torques can be transmitted through magnetic forces.

2. The centrifuge as recited in claim 1 wherein the coupling elements are circular disk-shaped bodies.

3. The centrifuge as recited in claim 2 further comprising magnets having a rectangular cross section on the coupling elements, the magnets having a narrow side and a long side, the magnets being arranged on the coupling elements so that a magnet longitudinal axis extends radially.

4. The centrifuge as recited in claim 3 wherein a lateral distance between first magnets of a first coupling element of the coupling elements corresponds essentially to a magnet distance between the first magnets and opposing second magnets of a second coupling element of the coupling elements, the first coupling element magnetically engaging the second coupling element.

5. The centrifuge as recited in claim 2 wherein the coupling elements include a first and a second coupling element, the first and second coupling elements being mounted in at least one of the first and second drive trains so the first and second coupling elements are capable of rotating about a common axis and are magnetically engaged, magnets being arranged along a circle on the top or bottom side of the first and second coupling elements.

6. The centrifuge as recited in claim 2 wherein the coupling elements include a first and a second coupling element mounted in at least one of the first and second drive trains to rotate about two parallel axes while magnetically engaged, magnets being arranged along a circle on the top or bottom side of the first and second coupling elements.

7. The centrifuge as recited in claim 2 wherein the coupling elements include a first and a second coupling element mounted in at least one of the first and second drive trains so the first and second coupling elements rotate about two axes perpendicular to one another, magnets being arranged on a circle on peripheral surfaces of the first and second coupling elements.

8. The centrifuge as recited in claim 2 wherein the coupling elements include a first and a second coupling element arranged in at least one of the first and second drive trains about two perpendicular axes, first magnets of the first coupling element being arranged on a peripheral surface, and second magnets of the second coupling element being arranged on a circle on a top or bottom side.

9. The centrifuge as recited in claim 2 further comprising magnets on the coupling elements, the magnets having a circular cross section.

10. The centrifuge as recited in claim 1 wherein the separation unit is connected to a first coupling element of the coupling elements, the first coupling element being magnetically engaged with a second coupling element of the coupling elements, the second coupling element being mounted on the rotating frame for rotation about an axis running across a frame axis of the rotating frame, the second coupling element being magnetically engaged with a third coupling element of the coupling elements mounted on the stand concentrically with the first coupling element.

11. The centrifuge as recited in claim 10 wherein the coupling elements include a fourth coupling element rotatably mounted on the rotating frame on a side opposite the second coupling element for rotation about a fourth axis running across the frame axis, the fourth coupling element being magnetically engaged with the first coupling element and with the third coupling element.

12. The centrifuge as recited in claim 1 wherein the coupling elements include a first coupling element having first magnets arranged on a circle and a second coupling element having second magnets arranged in a circle so that first magnetic poles of adjacent magnets of the first magnets are aligned in opposition to second magnetic poles of the second magnets.

13. The centrifuge as recited in claim 1 further comprising a drive shaft for driving the frame, the drive shaft being mounted rotatably and coaxially in a hollow shaft of the frame and being connected to a first coupling element of the coupling elements, a second coupling element of the coupling elements being magnetically engaged with the first coupling element and being connected to the separation unit.

14. The centrifuge as recited in claim 1 wherein the separation unit is connected to a first coupling element of the coupling elements, a second coupling element of the coupling elements being magnetically engaged with the first coupling element and being arranged in the frame to rotate about an axis parallel to a frame axis of the rotating frame, a second diameter of the second coupling element being larger than a first diameter of the first coupling element; the rotating frame being designed as a third coupling element magnetically engaging the second coupling element.

15. The centrifuge as recited in claim 1 wherein the separation unit is connected to a first coupling element of the coupling elements, a second coupling element of the coupling elements being magnetically engaged with the first coupling element and being mounted in the frame for rotation about a frame axis of the rotating frame; a third coupling element of the coupling elements connected to the second coupling element by gear members being mounted in the frame for rotation about an axis parallel to the frame axis, the frame being designed as a fourth coupling element magnetically engaging the third coupling element.

16. The centrifuge as recited in claim 1 wherein the separation unit is arranged in the frame.

17. A centrifuge comprising:

a stand;

a frame rotatably mounted on the stand;

a separation unit rotatably mounted on the frame;

a first drive train for transmitting a first torque to the separation unit;

a line for supplying and/or removing at least one fluid, the line leading from a stationary connection point and connected to the separation unit on a side of the separation unit facing away from the stationary connection point; and a second drive train for transmitting a second torque to the rotating frame, the separation unit and the rotating frame being driven so that the separation unit rotates in a same direction of rotation as rotating frame but at double speed;

the first and second drive trains having at least one stator, the at least one stator having a first and a second coil arrangement for directly transmitting the first and second torques to the separation unit and to the rotating frame, respectively, using magnetic forces.

18. The centrifuge as recited in claim 17 wherein the frame has a top and a bottom carrying plate, the separation unit being rotatably mounted on the top carrying plate, and the stator being arranged with the first and second coil arrangement between the top and bottom carrying plates.

19. The centrifuge as recited in claim 18 further comprising permanent magnets provided on the separation unit, the first coil arrangement generating a first rotational field for transmitting the first torque to the separation unit.

20. The centrifuge as recited in claim 19 wherein the permanent magnets are distributed at a uniform spacing around a circumference on a bottom side of the separation unit, magnetic poles of adjacent magnets of the permanent magnets being aligned in opposition to one another.

21. The centrifuge as recited in claim 18 further comprising permanent magnets provided on the rotating frame, the second coil arrangement generating a second rotational field for transmitting the second torque to the rotating frame.

22. The centrifuge as recited in claim 21 wherein the permanent magnets are distributed around a circumference at a uniform spacing on the bottom carrying plate, magnetic poles of adjacent magnets being aligned in opposition to one another.

23. The centrifuge as recited in claim 18 wherein the bottom carrying plate of the frame is rotatably mounted in a supporting body, the supporting body extending in the rotating frame, the stator being mounted on the supporting body.

24. A centrifuge comprising:

a stand;

a frame rotatably mounted on the stand;

a separation unit rotatably mounted on the frame;

a first drive train for transmitting a first torque to the separation unit;

a line for supplying and/or removing at least one fluid, the line leading from a stationary connection point and connected to the separation unit on a side of the separation unit facing away from the stationary connection point;

a second drive train for transmitting a second torque to the frame, the separation unit and the rotating frame being driven so that the separation unit rotates in a same direction as the frame but at double speed;

coupling elements arranged at a distance on at least one of the first and second drive trains, so that at least one of the first and the second torques can be transmitted through magnetic forces, wherein the coupling elements include a first coupling element having first magnets arranged on a circle, and a second coupling element having second magnets arranged in a circle, so that first magnetic poles of the first magnets are aligned opposite to adjacent second magnetic poles of the second magnets; and a drive shaft for driving the frame, the drive shaft being mounted rotatably and coaxially in a hollow shaft of the frame and being connected to the first coupling element, the second coupling element being magnetically engaged with the first coupling element and being connected to the separation unit.

25. A centrifuge comprising:

a stand;

a frame rotatably mounted on the stand;

a separation unit rotatably mounted on the frame;

a first drive train for transmitting a first torque to the separation unit;

a line for supplying and/or removing at least one fluid, the line leading from a stationary connection point and connected to the separation unit on a side of the separation unit facing away from the stationary connection point;

a second drive train for transmitting a second torque to the frame, the separation unit and the rotating frame being driven so that the separation unit rotates in a same direction as the frame but at double speed; and coupling elements arranged at a distance on at least one of the first and second drive trains, so that at least one of the first and the second torques can be transmitted through magnetic forces, wherein the coupling elements include a first coupling element having first magnets arranged on a circle, and a second coupling element having second magnets arranged in a circle, so that first magnetic poles of the first magnets are aligned opposite to adjacent second magnetic poles of the second magnets, and wherein the separation unit is connected to the first coupling element, the second coupling element being magnetically engaged with the first coupling element and being arranged in the frame to rotate about an axis parallel to a frame axis of the rotating frame, a second diameter of the second coupling element being larger than a first diameter of the first coupling element, and the rotating frame defining a third coupling element magnetically engaging the second coupling element.

26. A centrifuge comprising:

a stand;

a frame rotatably mounted on the stand;

a separation unit rotatably mounted on the frame;

a first drive train for transmitting a first torque to the separation unit;

a line for supplying and/or removing at least one fluid, the line leading from a stationary connection point and connected to the separation unit on a side of the separation unit facing away from the stationary connection point;

a second drive train for transmitting a second torque to the frame, the separation unit and the rotating frame being driven so that the separation unit rotates in a same direction as the frame but at double speed;

coupling elements arranged at a distance on at least one of the first and second drive trains, so that at least one of the first and the second torques can be transmitted through magnetic forces, wherein the coupling elements include a first coupling element having first magnets arranged on a circle, and a second coupling element having second magnets arranged in a circle, so that first magnetic poles of the first magnets are aligned opposite to adjacent second magnetic poles of the second magnets, wherein the separation unit is connected to the first coupling element, the second coupling element being magnetically engaged with the first coupling element and being mounted in the frame for rotation about a frame axis of the rotating frame; and a third coupling element of the coupling elements connected to the second coupling element by gear members mounted in the frame for rotation about an axis parallel to the frame axis, the frame defining a fourth coupling element magnetically engaging the third coupling element.

* * * * *

UNITED STATES PATENT AND TRADEMARK OFFICE

CERTIFICATE OF CORRECTION

PATENT NO. : 6,280,375 B1
DATED : August 28, 2001
INVENTOR(S) : Artur Meisberger et al.

It is certified that error appears in the above-identified patent and that said Letters Patent is hereby corrected as shown below:

Title page,
Foreign Application Priority Data, "198 01 761" should be changed to -- 198 01 767 --.

Signed and Sealed this

Twenty-sixth Day of February, 2002

*Attest:*

*Attesting Officer*

JAMES E. ROGAN
*Director of the United States Patent and Trademark Office*